US005175969A

United States Patent [19]

Knauf et al.

[11] Patent Number: 5,175,969

[45] Date of Patent: Jan. 5, 1993

[54] PARTITION PANEL

[75] Inventors: Marvin C. Knauf, Conklin; Steven J. Throndset, Kentwood; Linda M. Parker, Alto, all of Mich.

[73] Assignee: Steelcase Inc., Grand Rapids, Mich.

[21] Appl. No.: 711,661

[22] Filed: Jun. 6, 1991

[51] Int. Cl.[5] ..... E04H 3/00

[52] U.S. Cl. ..... 52/239; 52/221; 160/135

[58] Field of Search ..... 52/26, 239, 220, 221, 52/145, 243, 241, 282, 716, 718, 511, 475; 160/40, 43, 135, 351

[56] References Cited

U.S. PATENT DOCUMENTS 3,802,146 4/1974 Tacke et al. .
3,831,330 8/1974 Tacke et al. .
4,103,981 8/1978 Donahue et al. .
4,123,879 11/1978 Blodee et al. .
4,133,153 1/1979 Hage .
4,213,493 7/1980 Haworth .
4,265,502 5/1981 Blodee et al. .
4,296,579 10/1981 Proud .
4,375,010 2/1983 Mollenkopf .
4,394,809 7/1983 Sherwood et al. .
4,406,101 9/1983 Heidmann .
4,423,573 1/1984 Omholt et al. .
4,433,630 2/1984 Laborie .
4,446,663 5/1984 Stumpf et al. .
4,535,577 8/1985 Tenser et al. .
4,577,444 3/1986 Sanderson .
4,593,505 6/1986 Russell .
4,628,656 12/1986 Menchetti et al. .
4,631,881 12/1986 Charman .
4,638,618 1/1987 Iesaka et al. .
4,682,457 7/1987 Spencer .
4,685,255 8/1987 Kelley .
4,702,046 10/1987 Haugen et al. .
4,716,698 1/1988 Wilson et al. .
4,796,397 1/1989 Capaul . .
4,828,005 5/1989 Notley .
4,862,659 9/1989 Wilson et al. .
4,876,835 10/1989 Kelley et al. .
4,882,885 11/1989 Chatterson et al. .
4,887,401 12/1989 Gioscia .
4,891,922 1/1990 Hozer et al. .
4,905,334 3/1990 Oppenhuizen .
4,905,428 3/1990 Sykes .
4,947,601 8/1990 McGuire .
4,993,205 2/1991 Dull et al. .
4,996,811 3/1991 Dull et al. .

*Primary Examiner*—David A. Scherbel
*Assistant Examiner*—Creighton Smith
*Attorney, Agent, or Firm*—Price, Heneveld, Cooper, DeWitt & Litton

[57] ABSTRACT

A portable partition panel is provided for open office plans, and the like, and includes a panel frame and removable cover panels that removably attach thereto. Clips on the cover panels releasably engage side frame segments of the panel frame, and hooks on the bottom of the panel frame releasingly engage mating apertures on the cover panel to form a detachable interconnection therebetween. A top cap includes a catch which pulls the cover panels against the panel frame as the cap is installed to assist in securely, yet removably attaching the cover panels to the panel frame. Connectors on the cover panels can be removed and reinstalled, so that the cover panels can be installed in a second orientation to hide mars upholstery tears, and the like. Also, the panel frame includes an upwardly open channel for receiving articles such as wires in a raceway. The upper segment of the panel frame further includes a reduced cross-section that allows cables to be routed from the utility channel into the interior of the partition panel. Also, the side clips have a unique design which causes them to remain on the cover panel during removal and also controls the releasing motion of the panels.

28 Claims, 8 Drawing Sheets

XVIII

PARTITION PANEL

BACKGROUND OF THE INVENTION

The present invention relates to furnishings for open offices, and the like and in particular to movable room divider panels or partitions of the type having frame and removable cover panels.

Room divider systems are particularly popular in modern offices, since they allow large areas to be aesthetically and economically subdivided for maximum worker productivity. However, despite their flexibility, further improvements are desired. For example, most existing panel systems do not allow the exterior surfaces of the panels to be removed and replaced without significant effort and several tools. Some attempts have been made to solve this problem through the use of removable cover panels. However, in such systems, the removable cover panels are typically difficult to remove and/or securely reinstall. Also, present retention systems for holding the removable cover panels on their associated frame are not as positive as desired, thus leading to loose and misaligned cover panels. Further, clips and attachment brackets are often lost or damaged, aggravating the problem of inadequate attachment. Still further, dirty or damaged panels with exposed but only localized damage must be removed and replaced in order to satisfactorily refurbish an office layout.

Recently, room divider systems have been adapted to include raceways and the like for routing electrical power and telecommunication cables therethrough. Improvements in this aspect of portable partition panels is also desired. For one, the raceways provided for laying in cables are difficult to access, and often require some disassembly of panels. Other systems require that the cables be strung or threaded into the raceways. Further, in most systems, it is difficult to separate high voltage lines such as for dispensing electrical power from low voltage lines such as for telecommunication. This leads to mixed lines resulting in electrical interference therebetween. This potentially also creates maintenance hazards where the wires are poorly identified.

Thus, a panel system offering increased flexibility in panel placement, attachment, repair, and refurbishing is desired. Further, a system is needed in which high voltage lines are readily accessible and separatable from low voltage lines, while simultaneously also offering maximum flexibility in cable routing and placement.

SUMMARY OF THE INVENTION

One aspect of the present invention provides a freestanding, portable partition panel including a panel frame having opposing faces and a channel, a removable cap shaped to cover at least a portion of the channel, and at least one removable cover panel shaped to cover at least a portion of one of the faces of the panel frame. A catch connected with the cap operably engages a part of the cover panel to assist in securely yet removably attaching the cover panel to the panel frame.

Another aspect of the present invention provides a freestanding portable partition panel including a panel frame with at least one face and first and second connectors. Also provided is at least one cover panel shaped to cover the face, the cover panel having top and bottom portions that are generally symmetrical about a horizontal centerline. The cover panel further includes third and fourth connectors shaped to releasably engage the first and second connectors of the panel frame. The fourth connector is located adjacent the top portion of the cover panel, but is removable and reattachable adjacent the bottom portion, so that the cover panel can be readily removed from the panel frame and reattached in an inverted orientation to conceal mars, upholstery tears, and the like.

Yet another aspect of the present invention provides a freestanding portable partition panel including a panel frame having top and bottom frame segments interconnected to create a rigid frame structure having opposite faces and an interior, the panel frame including a utility raceway positioned either at the top or bottom of the panel frame. The partition panel also includes a removable cover panel for covering a face of the panel frame. The one of the top and bottom segments adjacent the utility raceway has a channel configured to permit routing utilities in the utility raceway through the channel and into the interior of the panel frame without interfering with the flush attachment of the cover panel to the panel frame. In the preferred embodiment, the one frame segment is swagged to permit routing utilities from the channel to the interior of the panel frame.

Yet another aspect of the present invention provides a freestanding portable partition panel including a panel frame having opposing side frame segments and opposite faces. Also provided is a removable cover panel shaped to cover one of the faces, the cover panel including inwardly oriented side flanges disposed adjacent the side frame segments. The partition panel includes spring clips positioned on at least one of the side flanges, with a first barb which engages the side frame segment and second and third barbs which engages the side flange of the panel frame to interconnect the cover panel and panel frame. The second and third barbs cause the spring clip to pivot thereby assisting in releasing the first barb from the panel frame without pulling the spring clip off of the cover panel.

Numerous advantages are found in the present invention over prior art. The removable cap and removable panel cover simplify installation, repair, replacement, and refurbishing of panel systems and reduce the need for multiple tools. Further, the cover panels that are attachable in inverted positions allowing localized mars and damaged panels to be inverted and reused. Still further, the spring clips facilitate cover panel installation and removal by remaining attached to the cover panel, thereby reducing the loss of clips and resulting loose and inadequately held cover panels. The removable cover panel also facilitates access to and repair of components housed within the interior of the panel, allowing increased use of the interior of the panel. Additionally, the removable cap allows ready access to an upwardly oriented raceway that permits cables to be laid continuously therein, thus permitting convenient installation and also rerouting of cabling placed therein. Further, the swagged channel or similarly shaped portion of the panel frame allows side access and laying in of cables to the interior of the partition panel, thereby facilitating installation of additional devices in the interior of the partition panel.

These and many other important advantages of the invention will be further understood and appreciated by those skilled in the art by reference to the following written specification claims, and appended drawings.

BRIEF DESCRIPTION OF THE PREFERRED EMBODIMENTS

Figures 2, 3, 4:
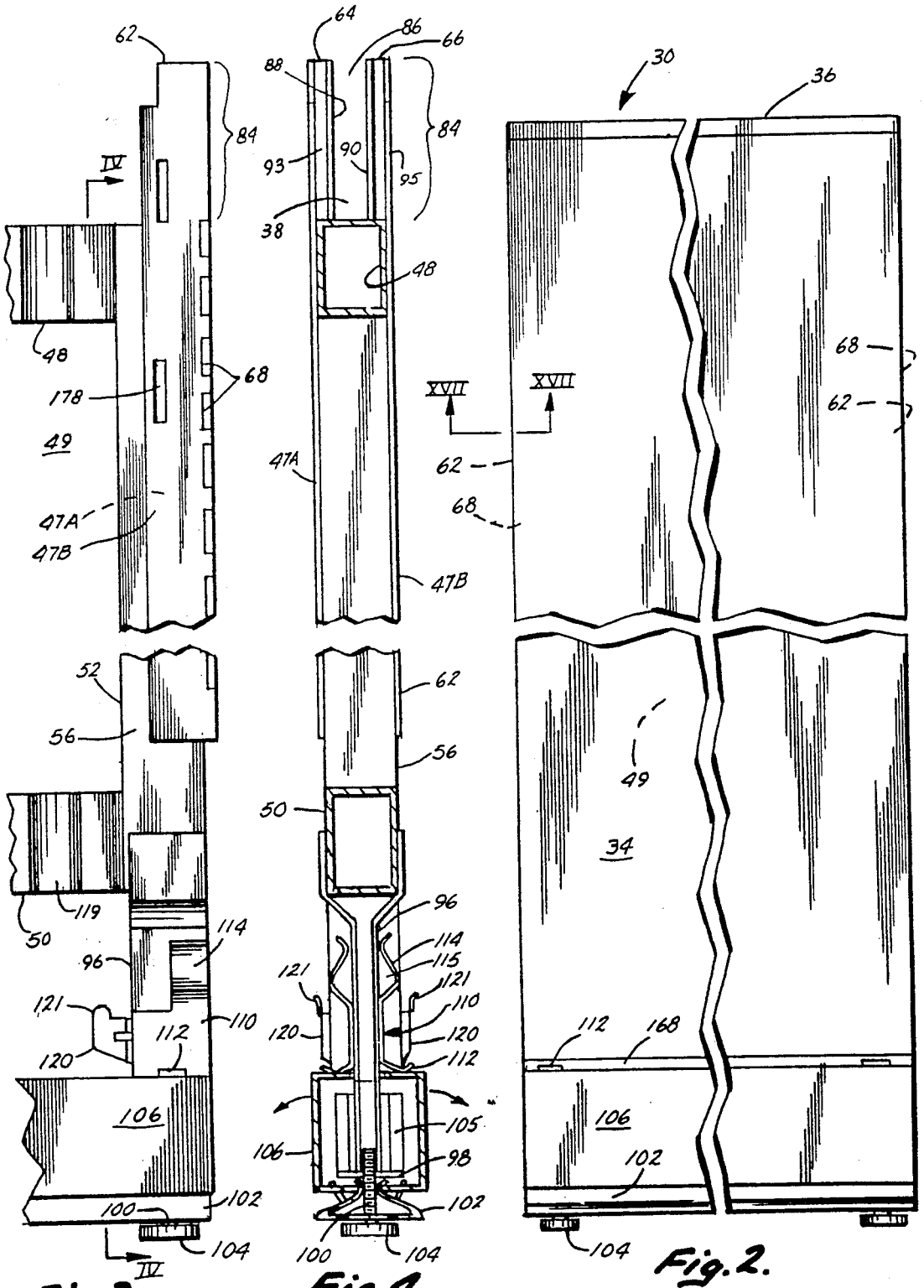
FIG. 2 is a fragmentary front elevational view of the assembled partition panel of FIG. 1.
FIG. 3 is a fragmentary side elevational view of the panel frame in FIG. 1.
FIG. 4 is a cross-sectional view taken along lines IV—IV in FIG. 3.

For purposes of description herein, the terms "upper," "lower," "right," "left," "rear," "front," "vertical," "horizontal," and derivatives thereof shall relate to the invention as oriented in FIG. 2. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

A freestanding portable room divider or partition panel 30 embodying the present invention (FIG. 1) is provided with a panel frame 32 and removable cover panels 34 that removably attach to the opposing faces thereon. A removable top cap 36 covers a continuous channel 38 in the top of panel frame 32. Cap 36 includes a catch or connector 40 which pulls cover panels 34 against panel frame 32 as cap 36 is installed on panel frame 32, thereby assisting in securely yet removably attaching the cover panels 34 to panel frame 32. Clips 42 on the inside of cover panels 34 releasably engage side frame segments 52, 54 on panel frame 32, and hooks 44 on the bottom of panel frame 32 releasingly engage mating apertures 146 on cover panels 34 to form a releasable, but secure interconnection therebetween for temporarily holding cover panel 34 on panel frame 32.

Panel frame 32 (FIG. 1) is a rigid framework having opposing faces 47A and 47B and an open interior 49, and is made of top and bottom structural members or frame segments 48 and 50 rigidly interconnected to opposing side frame segments 52 and 54. Side frame segments 52 and 54 are positioned at the lateral edges of panel frame 32 such that they can be interconnected to adjacent panels or to post connectors (not shown) to form a substantially continuous wall partition such as is often used in offices and the like. Side frame segments 52 and 54 are substantially identical mirror images of each other, and therefore only side frame segment 52 will hereinafter be described.

Figure 5:
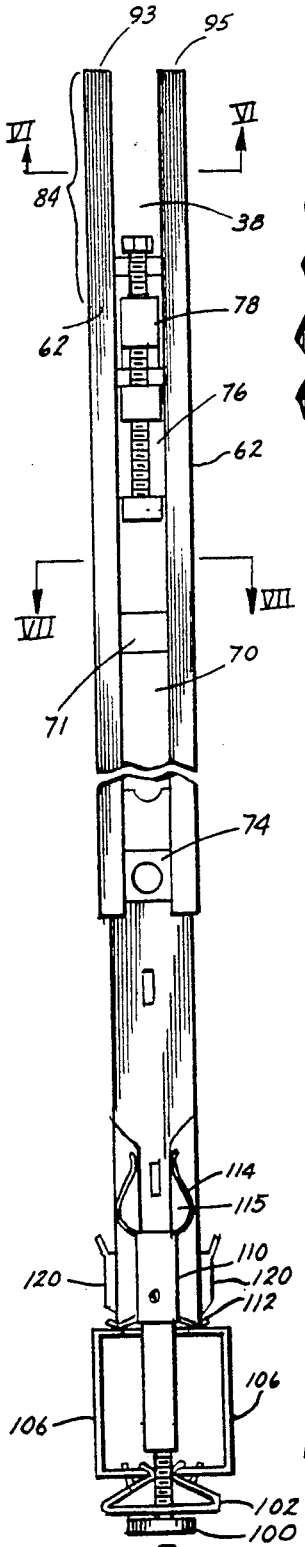
FIG. 5 is an end view of the panel frame in FIG. 3.

Side frame segment 52 (FIG. 3) includes a square tubular member 56 that extends vertically a distance short of the top and bottom of partition panel 30. Square tubular member 56 (FIG. 7) includes front and rear surfaces 58 and 60 and inner and outer surfaces 59 and 61. A "W" bracket 62 includes outer flanges 64 and 66 which attach to front and rear surfaces 58 and 60 so that the body of "W" bracket 62 extends laterally outwardly from outer surface 61. Outer flanges 64 and 66 include multiple slots or hanger slots 68 (FIG. 3) oriented vertically along outer flanges 64, 66. Slots 68 are useful for mounting various articles to partition panel 30 such as for modular furniture as is commonly known in the art, such as worksurfaces, cabinets, work modules, and the like. The center portion 70 (FIG. 5) of "W" bracket 62 includes attaching means for interconnection of adjacent panels as is also commonly known in the art. In the illustrated embodiment, center portion 70 (FIG. 5) includes several attachment openings 71 such as for holding attachment brackets 74 and 76 and clamp driver bracket 78. Brackets 74, 76 and 78 can be used to directly interconnect with mating brackets on adjacent panels, or alternatively to interconnect to intermediate posts (not shown) such as at "T" joints and at corners. Openings 71 are also useful for holding various trim attachments and end treatments.

Figure 6:
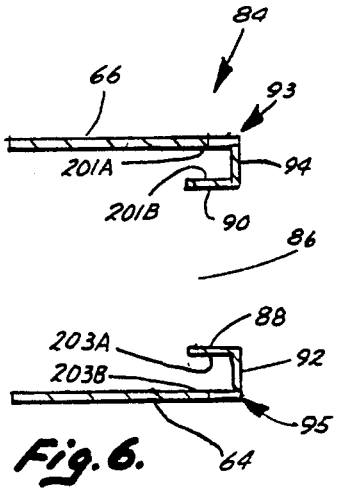
FIG. 6 is a cross-sectional view taken through lines VI—VI in FIG. 5.

"W" bracket 62 (FIG. 4) includes an upper portion 84 which extends upwardly above the upper end of square tubular member 56 and includes an extension of outer flanges 64 and 66 and center portion 70. In the preferred embodiment, the center web of center 70 in upper portion 84 is cut-away leaving an opening 86 and also leaving inner attachment flanges 88 and 90. Inner flanges 88 and 90 join with flat outer walls 92 and 94 and outer flanges 64 and 66 to form two corresponding brackets or posts 93, 95 that have an inwardly facing cross-sectional shape of a "C" (FIG. 6). Brackets 93, 95 extend upwardly in parallel and have a "goal post" like appearance, each post being mechanically and rigidly stable. Each C-shaped bracket 93, 95 is useful as an attaching flange for top cap 36 to center top cap 36 on panel frame 32. Upper portion 84 joins with the upper surface of horizontal square tubular member 48 to form an upwardly open generally vertical channel 38 (FIG. 4) which provides open area into which cables and other articles may be laid.

At the lower end of square tubular member 56 is a narrowed member 96 (FIG. 4) having a laterally inwardly facing "C" section, member 96 rigidly interconnected to a horizontal mounting structure 98. Horizontal mounting structure 98 extends laterally from side-to-side between members 96 on side frame segments 52, 54. Structure 98 is a substantially flat member with attachment flanges suitable for connecting electrical powerways, modules, and other similar articles. Threadably connected to the bottom of horizontal mounting structure 98 and narrowed member 96 are vertically adjustable stanchions 100 and feet 104 that provide for vertical adjustability and support of partition panel 30. A profiled extrusion 102 or other resilient cover is mateably attached to horizontal mounting structure 98 and cooperates with a feet 104 to aesthetically close off the "light seal" area below horizontal mounting structure 98 and the floor or other supporting surface. Extrusion 102 also provides area for routing communication cable via the bottom of panel.

A lower powerway such as powerway 105 (FIG. 4) for conducting electrical utilities and the like can be mounted on horizontal mounting structure 98. In the embodiment shown, opposing releasable access covers 106 are pivotally mounted on either side of mounting structure 98 for pivotal movement between a closed position as shown, and an open access position as indicated by the arrows. Also in the embodiment shown, a bracket 110 is secured onto narrowed member 96 and includes lower attaching tabs 112 for releasably securing access covers 106 in the closed position. Brackets 110 also include upper curvilinear cable management members/bumpers 114 that form apertures 115. Apertures 115 permit cables to be laid or routed horizontally therein within panel 30. Bumpers 114 also facilitate installation of cover panels 34 on panel frames 32, as described below.

Bottom frame segment 50 (FIG. 1) is substantially a horizontal square tubular member or cross-piece which extends between side frame segments 52 and 54 at the lower portion of frame 32, above the narrowed members 96. Top frame segment 48 is also substantially a horizontal square tubular member or cross-piece positioned at the upper portion of frame 32. Tubular members 48 and 50 collectively form a substantially rigid rectangular picture-frame like framework with side frame segments 52 and 54.

In the illustrated embodiment, 48 and 50 include a narrowed portion or channel 119 to facilitate routing utilities through panel 30. Channel 119 (FIGS. 7 and 8) is a narrowed cross-section creating a space between cover panel 34 and members 48 and 50 such that cables can be routed from a raceway in either channel 38, lower mounting structure 98, or bracket 114 to the interior 49 of panel 30, without interfering with the fit of cover panel 34 to panel frame 32. Preferably, channel 119 is formed by swagging, such that the structural integrity of panel frame 3 is not substantially compromised.

Two connectors 120 (FIG. 8) are positioned on the inside of narrowed members 96. In the preferred embodiment, these connectors 120 include upwardly protruding, opposing hooks or legs 121 that extend laterally inwardly and upwardly from the inner portion of narrowed tubular member 96. Hooks 121 are positioned slightly below bumpers 114 such that bumpers 114 serve to direct the installation of cover panel 34 onto hooks 121.

Figure 9:
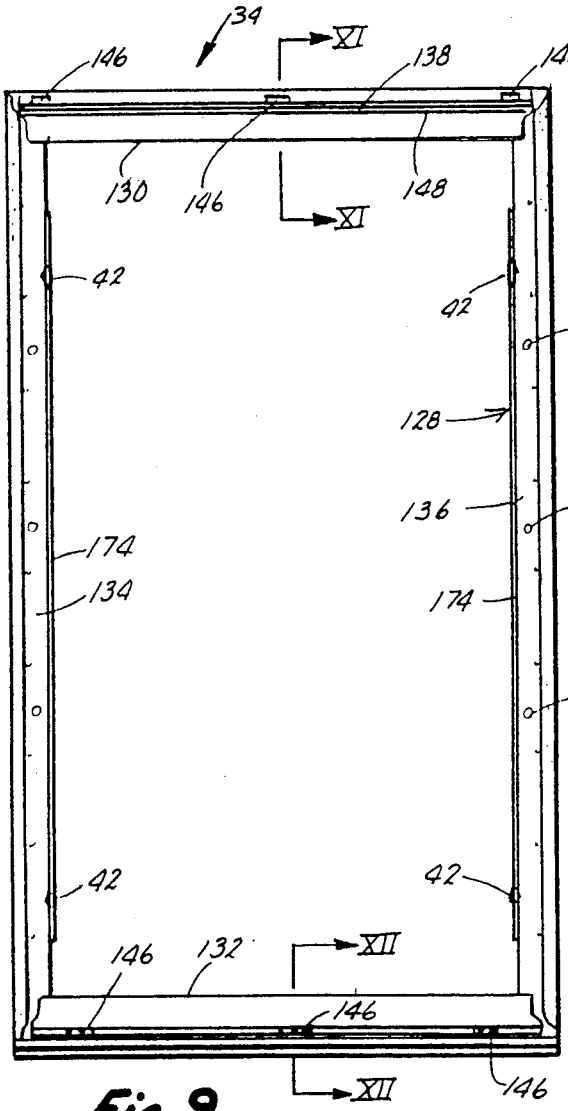
FIG. 9 is a rear elevational view of a cover panel.
Figure 10:
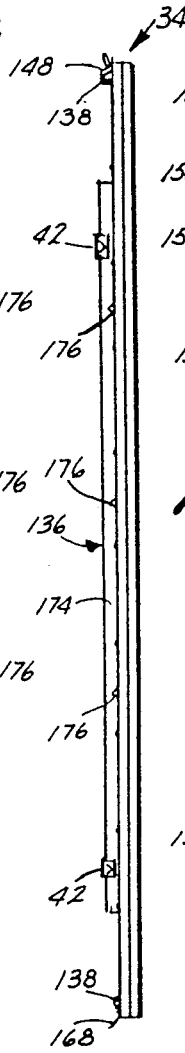
FIG. 10 is a side elevational view of the cover panel in FIG. 9.
Figure 11:
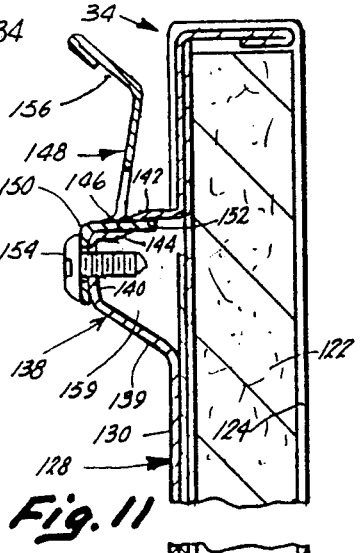
FIG. 11 is a cross-sectional view taken along lines XI—XI in FIG. 9.
Figure 12:
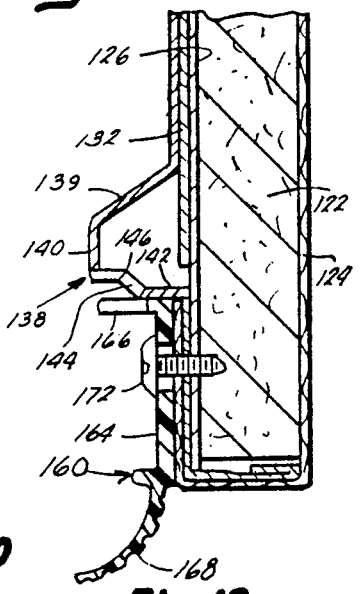
FIG. 12 is a cross-sectional view taken along lines XII—XII in FIG. 9.
Figure 11A:
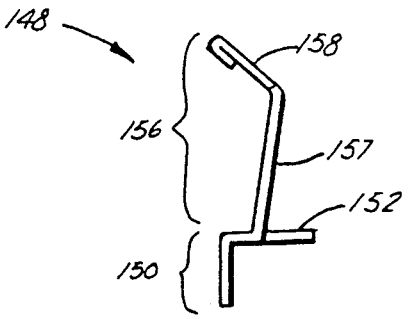
FIG. 11A is a side view of a connector.
Figure 11B:
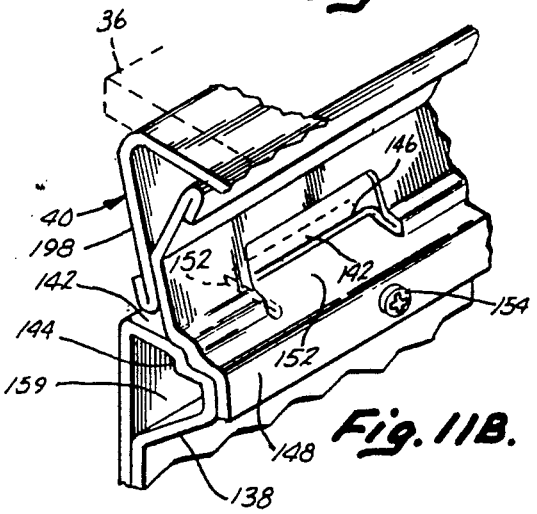
FIG. 11B is a perspective view of the connector as installed.

It is contemplated that cover panel 34 can be made of any of a number of different materials such as are often used in partition panels for dividing office areas into offices subdivided rooms and the like. However, in the preferred embodiment, cover panel 34 (FIGS. 9–12) is substantially a rectangular or square planar laminate structure attached to a cover panel frame 128. Cover panel frame 128 (FIG. 9) includes upper and lower members 130, 132 rigidly interconnected to side members 134, 136 to form a substantially planar rectangular framework. The laminate structure (FIGS. 11 and 12) is attached to one side of frame 128 and includes a sheet of composite material 122 covered on an exposed side by an upholstery or woven sheet 124 for aesthetics, and is further covered on the hidden interior side by a sound barrier 126. Materials 122, 124, and 126 are integrally laminately bonded or otherwise attached to the flat side of cover panel frame 128. Upper and lower members 130, 132 each include an identical continuously profiled cross-section or leg or flange-like connector 138 which forms a hollow ridge horizontally extending fully across the upper and lower parts of the upper or lower cover panel frame members 130, 132 respectively. In the preferred embodiment, leg 138 includes an angled wall 139, an inwardly facing flat wall 140, and stepped upper wall 142 having a step 144. Multiple apertures 146 are located periodically longitudinally in stepped wall 142 adjacent step 144. An elongated connector bracket 148 (FIG. 11A) includes a profile having an attachment portion 150 and an upstanding connector portion 156. Attachment portion 150 mateably sets against flat wall 140 and stepped wall 142 outside of step 144, and includes tabs 152 that fit within apertures 146 to securely locate connector bracket 148 on cross-section 138 (FIG. 11B). Screws 154 are threadably installed into flat wall 140 adjacent apertures 146 to permanently but removably secure connector bracket 148 to cover panel frame 128 and hold tabs 152 within apertures 146. Connector bracket 148 further includes a second portion 156 that extends upwardly from first portion 150. Second portion 156 includes two segments 157 and 158, segment 157 angling upwardly and outwardly slightly from vertical toward the outside of cover panel 34, and segment 158 connected thereto and angling inwardly and upwardly therefrom. Segment 157 is shaped to provide a resilient connector for top cap 36, while segment 158 is designed to provide a ramp to direct the engagement of connector 40 on top cap 36 with cover panel 34.

Lower member 132 (FIG. 12) includes an identical profiled cross-section 138 positioned in opposing relationship along and near a bottom edge of cover panel 34. Cross-section 138 on lower member 132 also includes apertures 146 as noted above. An aesthetic extrusion 160 is positioned below cross-section 138 and against the inside of lower member 132, extrusion 160 including a flat upper flange 164 with notches 166 cut therein to fully expose apertures 146. Extrusion 160 further includes a downwardly and inwardly draping resilient flap 168 designed to matingly abut the top of lower raceway access covers 106. Flap 168 includes notches (not shown) which mateably overlap attaching tabs 112 on lower raceway access cover 106 to form a more uniform and aesthetic appearance. Extrusion 160 is attached to lower member 132 such as by screws 172 at multiple locations along its width. A filler plug (not shown) may be added to the inside 159 of ridge 138 to fill the space therein and assure the dimensional integrity of 138 such as during shipping wherein leg 138 may experience abnormally high stress.

Figure 1:
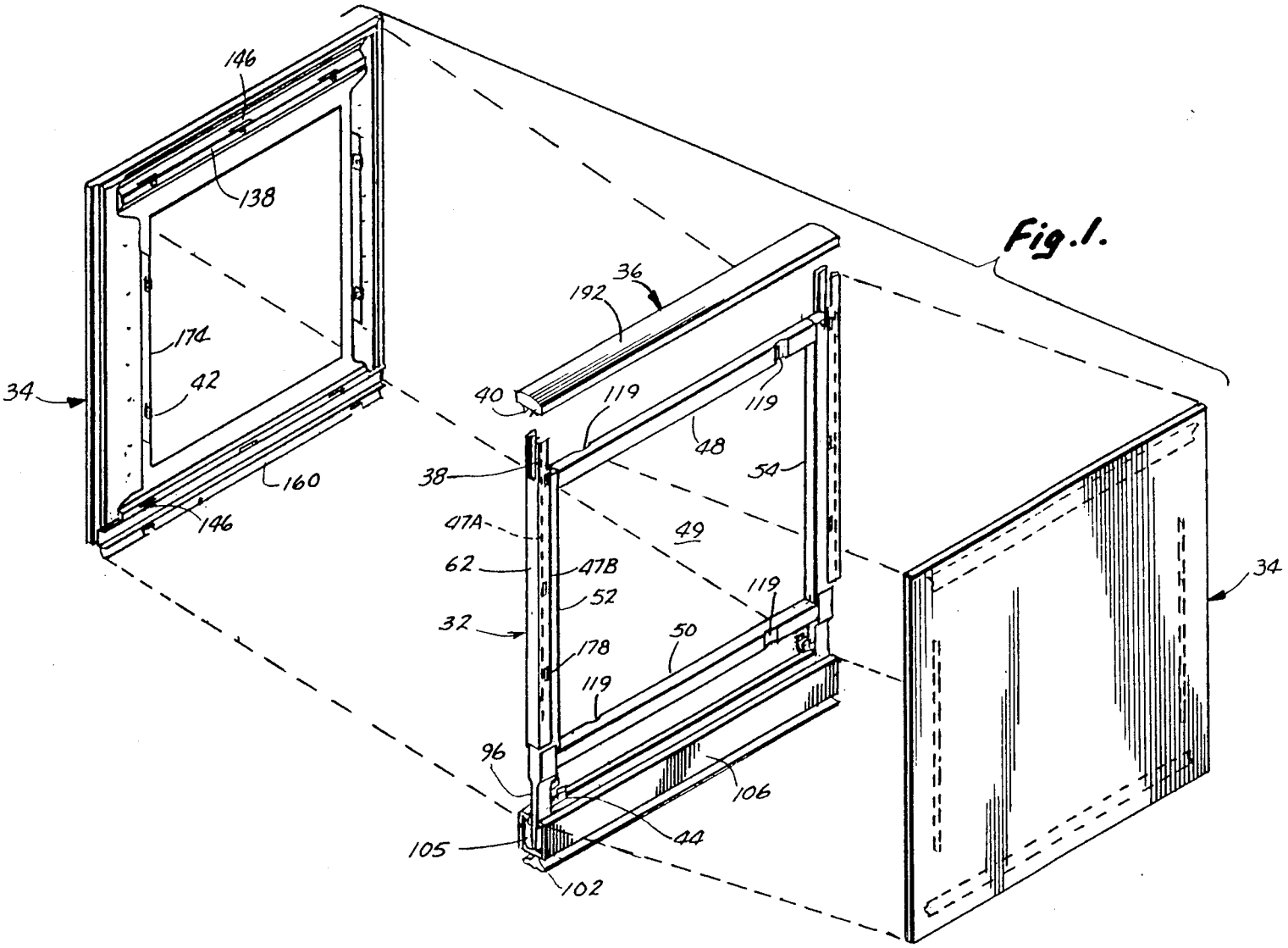
FIG. 1 is an exploded perspective view of a freestanding portable partition panel embodying the present invention.
Figure 7:
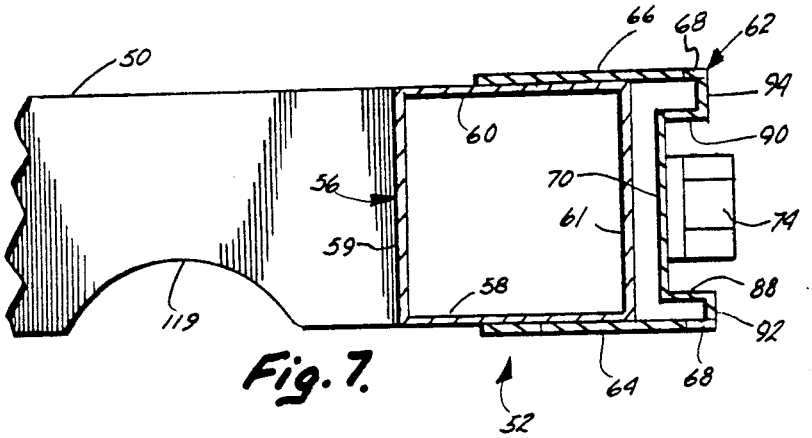
FIG. 7 is a cross-section taken along lines VII—VII in FIG. 5.
Figure 8:
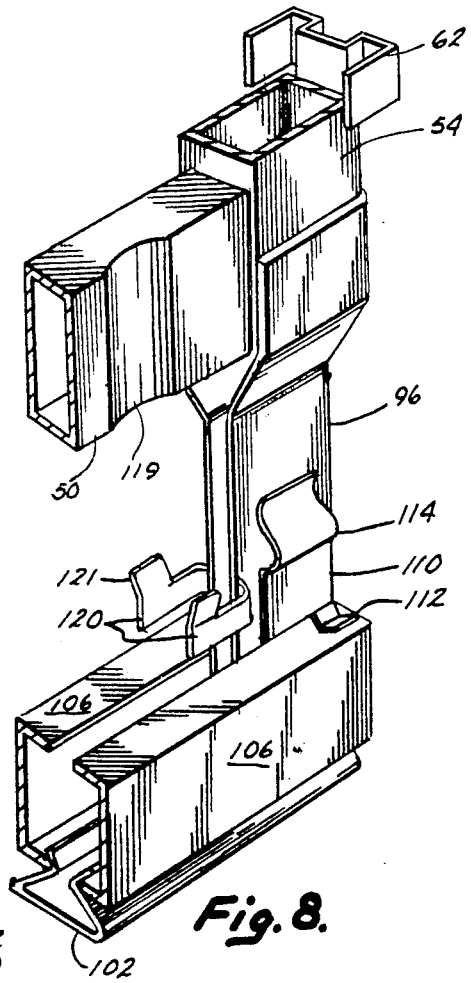
FIG. 8 is a fragmentary perspective view of a lower corner of the panel frame in FIG. 5.

Side members 134 and 136 (FIGS. 9 and 10) are substantially mirror images of each other, and include inwardly directed side flanges 174. Side flanges 174 are foreshortened and designed to fit between horizontal square tubular members 48 and 50 and adjacent the inner surfaces 59 of square tubular members 56 of side frame segments 52, 54 (FIG. 1). As discussed below, side flanges 174 are designed to receive clips 42 which engage the inside of square tubular members 56 to assist in providing a releasable but secure attachment for cover panel 34 to panel frame 32. Also located on side members 134 and 136 and outside of flanges 174 are conical protrusions 176 which serve to locate cover panel 34 on panel frame 32 by abutting front and rear surfaces 58 and 60 of square tubular members 56 (FIG. 7). Conical protrusions 176 standoff cover panel 34 from square tubular frame members 56 thereby resulting in the correct panel width of 3".

Clips 42 (FIGS. 13-18) are U-shaped clips made of steel having opposing walls 180 and 182 (FIG. 14), one of which includes a bent section 184 that creates a throat such that clip 42 is readily installed on a sheet metal flange such as flange 174. Wall 180 also includes two barbs 186, 188 which are directed inwardly and designed to engage side flange 174 and retain clip 42 when clip 42 is placed thereon. Opposing wall 182 includes a centered enlarged barb 190 which is directed outwardly and angled downwardly in a generally opposite direction to barbs 186, 188. Enlarged barb 190 is constructed to engage the inner side of square tubular member 56 on side frame segments 52 and 54 as cover panel 34 is installed on panel frame 32 (FIGS. 17 and 18).

Clip 42 (FIG. 16) is uniquely designed such that when cover panel 34 is removed from panel frame 32, one of barbs 186, 188 will release from side flange 174 before the other. This causes clip 42 to rotate on side flange 174 as shown by the arrows thus helping to release enlarged barb 190 from engagement with the inside of square tubular member 56. As clip 42 is rotated, centered enlarged barb 190 is eventually released. However, due to the position of barbs 186, 188, at least one of the barbs 186, 188 remains engaged on side flanges 174 thus retaining clip 42 on cover panel 34. This unique feature is very advantageous in that clips 42 tend to remain attached to cover panel 34 as opposed to being lost, misplaced, broken, or otherwise unusable. This reduces the frustration often experienced due to lost clips during reinstallation of cover panels 34 on panels frames 32. Further, clips 42 improve the release and removal of cover panels 34 from panel frame 32. Still further, clips 42 cooperate with side flanges 174 to center cover panel 34 relative to frame 32.

Figures 13, 14, 15, 16, 17, 18, 19, 20, 21:
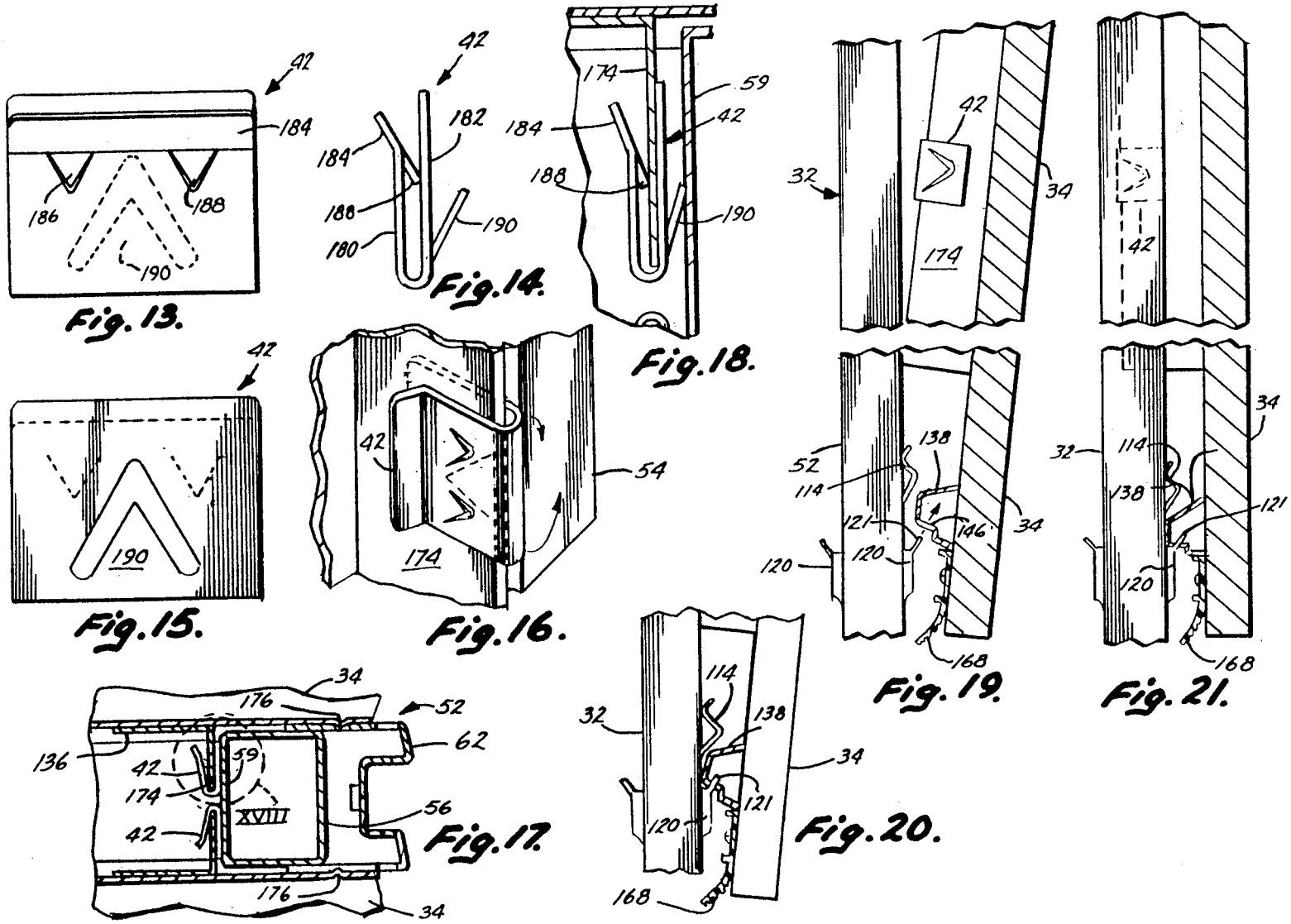
FIG. 13 is an elevational view of a clip.
FIG. 14 is a side view of the clip in FIG. 13.
FIG. 15 is an elevational view of the opposite side of the clip in FIG. 13.
FIG. 16 is a perspective view of the clip shown as installed.
FIG. 17 is a cross-section taken along lines XVII—XVII in FIG. 2.
FIG. 18 is an enlargement of the circled portion XVIII in FIG. 17.
FIG. 19 is a schematic showing a cover panel ready to be install on the panel frame.
FIG. 20 is a schematic showing the cover panel partially installed the panel frame.
FIG. 21 is a schematic showing the cover panel fully installed on the panel frame.
Figure 22:
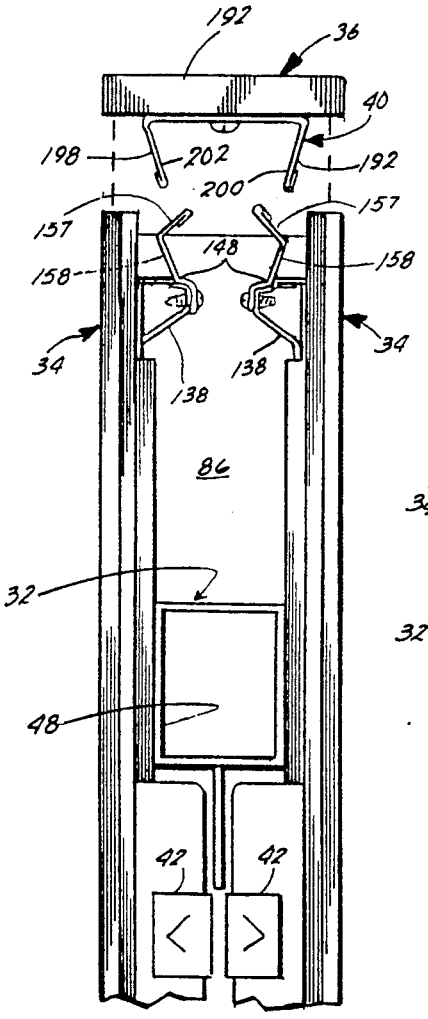
FIG. 22 shows the removable cap ready to be installed on a cover panel and panel frame assembly.

Cover panel 34 (FIG. 19) is installed on panel frame 32 by holding cover panel 34 at a slight angle to panel frame 32 such that apertures 146 in cross-section 138 of lower member 132 can be installed on hooks 121 of connector 120 of member 96 (FIG. 20). Bumpers 114 assist in positioning cover panel 34 so that it can be properly installed on panel frame 32. Cover panel 34 is pivotally rotated to a fully installed vertical position (FIGS. 17 and 21) wherein clips 42 and specifically enlarged barbs 190 engage the inner side 59 of square tubular members 56 of side frame segments 52, 54. In this fully installed position, the upper portion of cover panels 34 are in opposing relationship and extend above horizontal square tubular member 48 (FIG. 22). This forms a U-shaped continuous and generally vertically oriented channel 38 that is upwardly open, in which wires, cables and other articles can continuously be laid from above and continuously from panel to panel.

Figure 23:
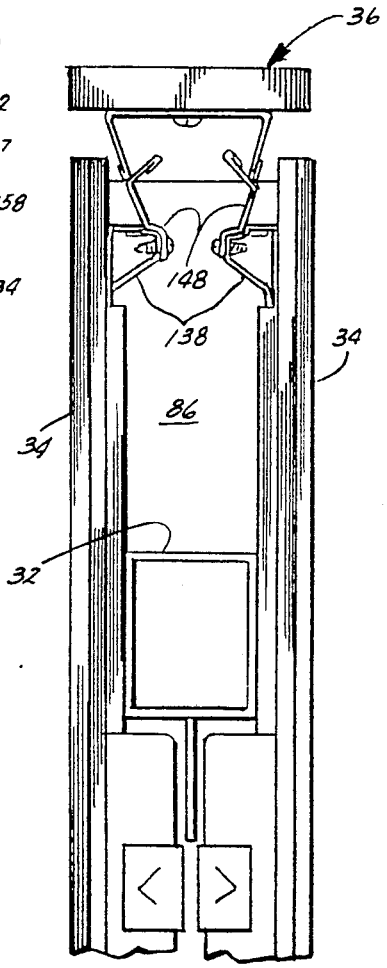
FIG. 23 shows the removable cap as partially installed on the cover panel and panel frame assembly.
Figure 24:
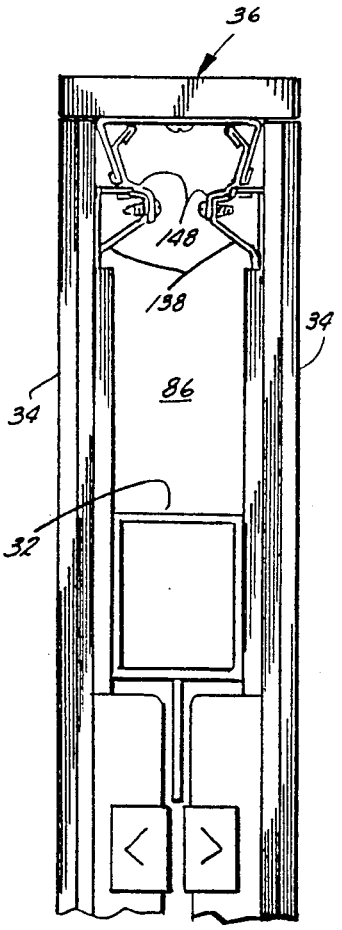
FIG. 24 shows the removable cap as fully installed on the cover panel and panel frame assembly.

A removable cap 36 (FIGS. 22-24) is optimally constructed to mateably fit over channel 38 and hold two cover panels 34 positioned on either side of panel frame 32 in place. The present invention contemplates that cap 36 could be constructed so as to be able to hold only a single cover panel 34 in place on panel frame 32. However, in the present example, cap 36 is shaped to retain two, oppositely facing cover panels 34 in place. The illustrated cap 36 includes an aesthetically covered portion 192 (FIG. 1) which is designed to mateably install over the upper opening of channel 38. Removable cap 36 further includes a downwardly extending portion or catch 40 connected to the underside of the upper portion 192. Catch 40 (FIG. 22) forms an inverted U-shaped configuration with two oppositely facing inwardly inclined legs 198 which define ramps or inclined surfaces 200 and 202. Ramps 200 and 202 are constructed to matingly ramp off of segment 157 (FIG. 23) and into secure engagement with segment 158 (FIG. 24) of the upwardly extending second portion of elongated connector brackets 148 as cap 36 is installed onto cover panels 34 and over panel frame 32. Ramps 200 and 202 thereby capture the upper portion of cover panel 34 and pull the upper portions of cover panels securely against the frame. Ramps 200, 202 also potentially engage surfaces 201A, 201B, 203A and 203B (FIG. 6) on the upper portion 84 of panel frame 32 so as to positively center and secure cover panels 34 in place on panel frame 32.

Figure 26:
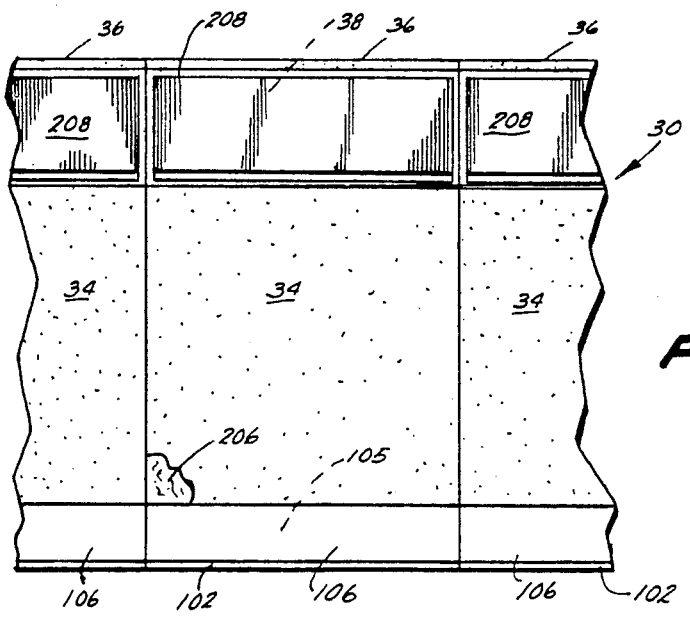
FIG. 26 is an elevational front view of an arrangement of interconnected partition panels with storage bins mounted thereon, one of the cover panels having a cover panel with a damaged corner.
Figure 29:
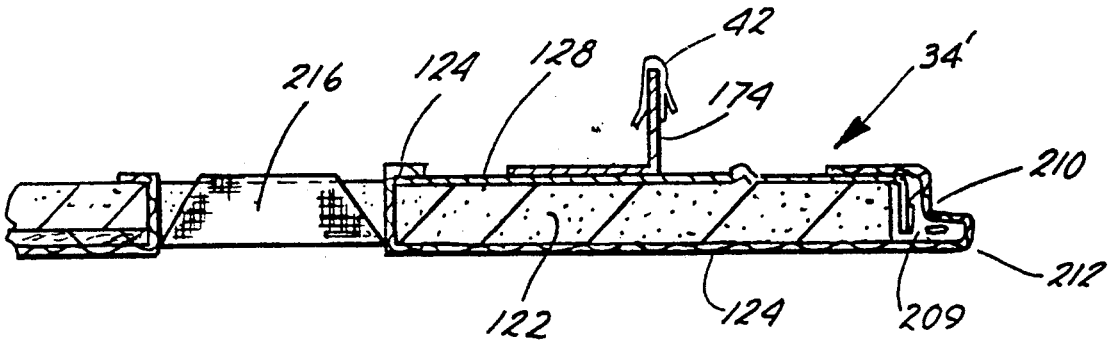
FIG. 29 is a cross-section of the cover panel taken along lines XXIX—XXIX in FIG. 28.

It is contemplated that partition panel 30 and particularly cover panels 34 can be interconnected in a number of ways. The partition panel 30 shown in FIG. 26, for example, includes panels 30 which are joined adjacently side by side in a continuous wall configuration and include continuous upper and lower channels (FIG. 26). In the embodiment shown, cover panel 34 includes a resilient member 209 clipped onto the edge of panel 30 forming a tapered edge 210 (FIG. 29) with a resiliently deformable lip 212 that abuts adjacent tapered edges on adjacent panels to hide hanger slots 68 on panel frames 32. At the same time, the resiliency of lips 212 permit access thereto between adjacent panels 30 such as for attachment of the hangers (not shown) for modular storage bins 208 (FIG. 26). However, it should be noted that panel 30 can also be interconnected to a post connector (not shown) such as is particularly useful to form an "L" corner or "T" joint.

Figure 27:
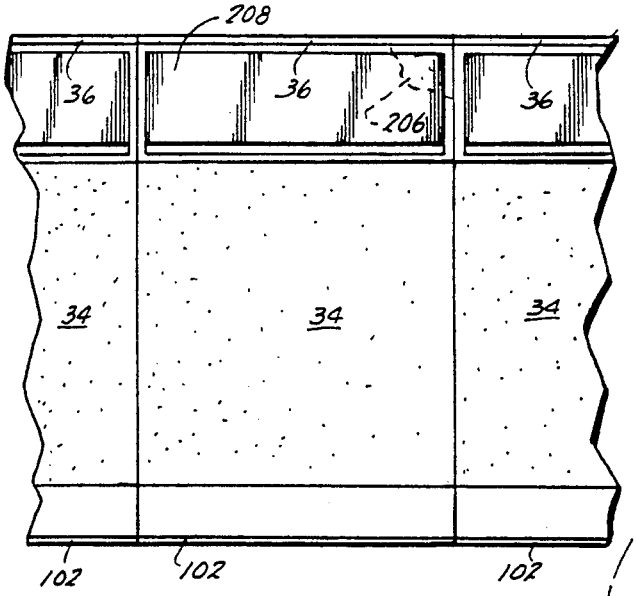
FIG. 27 is an elevational front view of the arrangement in FIG. 26 but with the damaged cover panel inverted.
Figure 25:
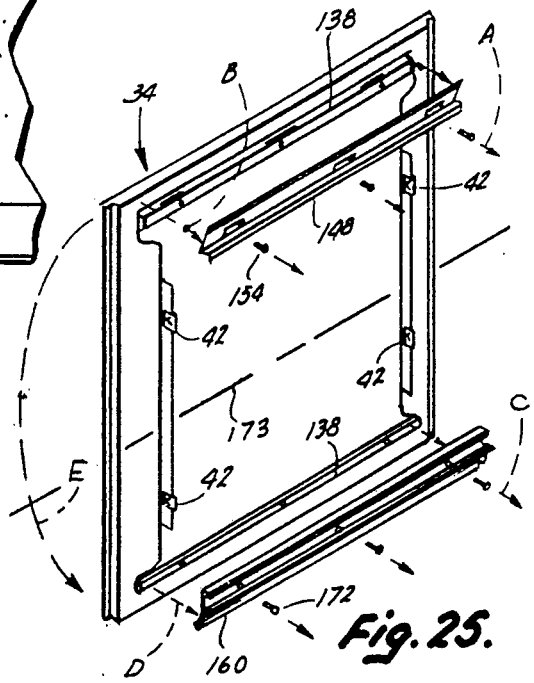
FIG. 25 is a perspective view of a cover panel illustrating the steps to inverting the cover panel.

Cover panel 34 (FIG. 25) is symmetrical about a horizontal centerline 173 and is uniquely arranged such that elongated connector bracket 148 and extrusion 160 can be removed and relocated on cover panel 34 so that cover panel 34 can be reinstalled on panel frame 32 in an inverted orientation 180 from its previous position. As noted in FIG. 25, this is accomplished simply by removing screws 154 and 172 (steps A–D), reversibly repositioning bracket 148 and extrusion 160 (step E), and reinstalling screws 154 and 172. This allows cover panel 34 to be reinstalled on panel frame 32 in an inverted position which is 180° rotated from the original position. This is advantageous when a cover panel 34 has localized damage that can be hidden such as shipping, installation, or service damage (e.g. stains or tears) as indicated by numeral 206 in FIG. 26, but the panel is substantially undamaged and is otherwise useable. Cover panel 34 can be rotated to a position wherein localized damage 206 is hidden. In the example shown (FIG. 27), cover panel 34 has been rotated so that a modular overhead storage bin 208 hides damage 206. Damage 206 could also be hidden such as by moving the damage to a position behind or under a worksurface.

Figure 28:
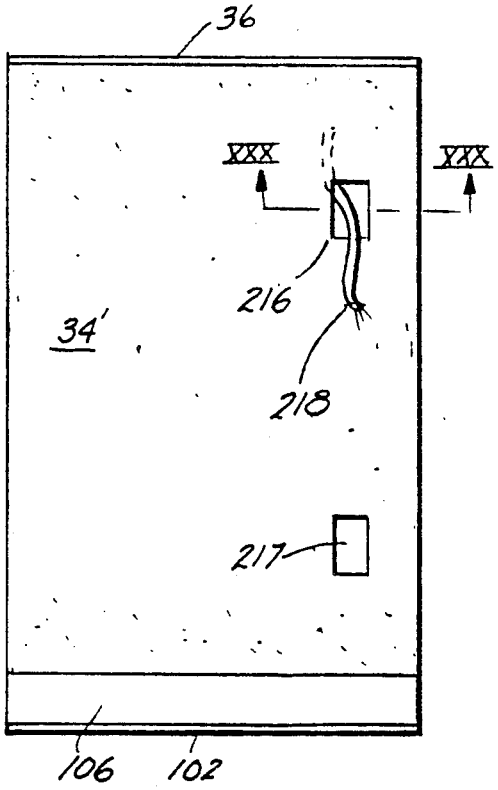
FIG. 28 is an elevational view of an assembled partition panel including an opening for routing cables therethrough.

In another embodiment, a partition panel 34 (FIG. 28) is provided with an opening 216 or 217 such that cabling 218 can be routed from the upper or lower raceways through swagged channel 119 and the internal space 49 formed by panel frame 32, and outwardly through an opening 216 to an article to be used. For example, opening 216 would be useful such as for providing electrical power to a lighting fixture (not shown) in a modular furniture arrangement such as under a hangable storage bin (FIG. 27) or cabinet (not shown).

Thus, a freestanding portable partition panel is provided having removable cover panels that attach to the opposing faces of a panel frame. The cover panels include clips that engage the panel frame to semi-securely hold cover panels in place on the panel frame. The cover panel further includes upper and lower connectors, the lower connectors being apertures that engage hook-like connectors on the bottom of the panel frame, and the upper connectors being releasably engaging connectors that receivably engage a catch on the top cap. The connectors on the cover panel can be relocated so that the cover panel can be inverted, such as to hide localized damage to the panel. The panel frame includes an open interior that is accessible by removing the cover panel. Further, the panel frame includes upper and lower portions that can be used as raceways for continuously laying of cables therein.

In the foregoing description, it will be readily appreciated by those skilled in the art that many modifications may be made to the invention without departing from the concepts disclosed here. Such modifications are to be considered as included in the following claims unless these claims by their language expressly state otherwise.

The embodiments of the invention in which an exclusive property or privilege is claimed are defined as follows.

1. A freestanding, portable partition panel for open office plans, and the like, comprising:

a panel frame having opposite faces and a channel adapted to house selected articles therein;

a removable cap shaped to enclose at least a portion of said channel;

means for detachably connecting said cap with said panel frame;

at least one cover panel shaped to cover at least a portion of one of the faces of said panel frame, and having a first portion thereof, and a second portion thereof with a connector positioned adjacent the channel of said panel frame;

means for detachably connecting the first portion of said cover panel with said panel frame;

a catch associated with said cap, and having an engaging portion thereof which when said cap is assembled onto said panel frame, operably engages the connector on the second portion of said cover panel, and thereby pulls said cover panel against said panel frame to assist in securely, yet removably attaching said cover panel to said panel frame.

2. A panel as set forth in claim 1, wherein:

said engaging portion is configured to detachably retain said cap on said panel, and thereby define said cap connecting means.

3. A panel as set forth in claim 2, wherein:

said connector includes an inwardly inclined lead to facilitate engagement with the engaging of said catch.

4. A panel as set forth in claim 3, wherein:

said catch has an inverted U-shaped configuration with oppositely facing, inwardly inclined legs, at least one of which defines said engaging portion and is in the shape of a ramp.

5. A panel as set forth in claim 4, wherein:

said channel extends along a top portion of said panel frame, and is particularly adapted to retain selected utilities therein.

6. A panel as set forth in claim 5, wherein:

said cover panel comprises a first cover panel, and selectively covers the one face of said panel frame; and including a second cover panel that selectively covers the other face of said panel frame;

said second cover panel having a first portion thereof with means for detachably connecting the same with said panel frame, and a second portion thereof with a connector shaped to engage the ramp on the catch of said cap, whereby when said cap is assembled onto said panel frame, said catch pulls both said first and second panels securely against panel frame.

7. A panel as set forth in claim 6, wherein:

said channel defines a raceway which is accessible by removing said cap, and which extends continuously along adjacent partition panels.

8. A panel as set forth in claim 7, wherein:

said frame has an open interior, and includes a horizontal structural member, below said channel with means for permitting routing utilities in said raceway past said structural member and into the open interior of said panel frame.

9. A panel as set forth in claim 8, wherein:

said utility routing means comprises a reduced cross-section portion of said structural member which forms a space between said cover panel and said panel frame through which utilities can be routed.

10. A panel as set forth in claim 9, wherein:

said cover panel includes means for connecting the same with said panel frame in different orientations.

11. A panel as set forth in claim 1, wherein:

said cover panel includes opposite side flanges; and said means for detachably connecting said cover panel with said panel frame includes a plurality of clips mounted on said side flanges and engaging said panel frame to assist in holding and centering said cover panel on said panel frame.

12. A freestanding, portable partition panel for open office plans, and the like, comprising:

a panel frame with at least one face thereof having a first connector disposed at a base portion of said panel frame, and a second connector disposed at an upper portion of said panel frame;

at least one cover panel shaped to cover the one face of said panel frame, and being substantially rigid to facilitate supporting said cover panel on said panel frame; said cover panel having top and bottom portions, a horizontal centerline, and a front plan configuration that is generally symmetrical with said horizontal centerline;

a pair of third connectors, each shaped to releasably engage the first connector of said panel frame, and being positioned adjacent the top and bottom portions respectively of said cover panel in a symmetrical relationship with respect to the horizontal centerline of said cover panel;

a fourth connector, shaped to releasably engage the second connector of said panel frame, and positioned adjacent the top portion of said cover panel;

means for removably attaching said fourth connector to said cover panel, whereby said cover panel can be readily removed from said panel frame and reattached thereto in an inverted orientation to conceal mars and the like by simply removing said fourth connector from the top portion of said cover panel, and connecting the same to the bottom portion of said cover panel.

13. A panel as set forth in claim 12, wherein:

said cover panel includes a cover frame with upper and lower legs, each having at least one aperture shaped to receive said first connector therein to define said third connectors.

14. A panel as set forth in claim 13, wherein:

said panel frame includes a top channel with a removable cap disposed thereover; and said second connector comprises a catch connected with said cap.

15. A panel as set forth in claim 14, wherein:

said catch includes a ramp, which when said cap is assembled onto said panel frame, operably engages the fourth connector on said cover panel, and thereby pulls said cover panel against said panel frame to assist in securely, yet removably attaching said cover panel to said panel frame.

16. A panel as set forth in claim 15, wherein:

said cover panel includes opposite side flanges having clips mounted thereon that engage interior portions of said panel frame to assist in detachably retaining said cover panel on said panel frame.

17. A panel as set forth in claim 16 wherein: said panel frame includes a lower raceway.

18. A panel as set forth in claim 12, wherein:

said panel frame includes a top channel adapted to house selected articles therein with a removable cap disposed thereover; and said second connector comprises a catch connected with said cap.

19. A panel as set forth in claim 18, wherein: said catch includes a ramp, which when said cap is assembled onto said panel frame, operably engages the fourth connector on said cover panel, and thereby pulls said cover panel against said panel frame to assist in securely, yet removably attaching said cover panel to said panel frame.

20. A panel as set forth in claim 12, including:

a utility raceway located along an upper portion of said panel frame to permit routing of utilities into the interior of said panel frame without interfering with the flush attachment of said cover panel to said panel frame.

21. A panel as set forth in claim 21, wherein:

said panel frame includes a horizontal structural member below said raceway having a reduced cross-section to form a spaced between said cover panel and said panel frame through which utilities can be routed.

22. A freestanding, portable partition panel for open office plans, and the like, comprising:

a panel frame having top and bottom frame segments and opposed side frame segments fixedly interconnected to create a rigid frame structure with opposite faces, and an interior; said panel frame including a utility raceway positioned adjacent one of said top and bottom frame segments, and extending along an exterior side thereof;

at least one removable cover panel shaped to cover one of the faces of said panel frame;

means for detachably mounting said cover panel flush against the one face of said panel frame;

at least one generally vertically oriented channel disposed in said one of said top and bottom frame segments at that side thereof associated with the one face of said panel frame; said channel being configured to permit routing utilities in said utility raceway through said channel and into the interior of said panel frame without interfering with the flush attachment of said cover panel to said panel frame.

23. A panel as set forth in claim 22, wherein:

said one of said top and bottom frame segments has a substantially uniform cross-sectional shape between said side frame segments, except at said channel which has a reduced cross-section to form a space between said cover panel and said panel frame through which utilities can be routed.

24. A panel as set forth in claim 23, wherein:

said one of said top and bottom frame segments is swagged at said portion having reduced cross-section to form said one segment without substantially reducing the structural integrity of said panel frame.

25. A freestanding, portable partition panel for open office plans, and the like, comprising:

a panel frame having opposed side frame segments, and opposite faces;

at least one removable cover panel shaped to cover one of the faces of said panel frame, and being substantially rigid to facilitate supporting said cover panel on said panel frame; said cover panel including opposed, inwardly oriented side flanges disposed adjacent interior sides of the side frame segments of said panel frame when said cover panel is mounted on said panel frame;

means for detachably connecting said cover panel with said panel frame, including at least one spring clip positioned on one of the side flanges of said cover panel, with an outwardly protruding first barb which abuttingly engages the interior side of an adjacent side frame segment to interconnect said spring clip and said panel frame; said spring clip further including inwardly protruding second and third barbs which abuttingly engage an adjacent side of said one side flange to interconnect said spring clip and said cover panel; said second and third spring clip barbs being spaced apart longitudinally on said spring clip, whereby movement of the cover panel away from said panel frame to remove said cover panel causes said spring clip to pivot about one of said second and third barbs, and thereby assist in releasing the engagement of said first barb with said panel frame, without pulling said spring clip off of said cover panel.

26. A panel as set forth in claim 25, wherein:

said cover panel connecting means also includes locating means for securely locating said cover panel adjacent said panel frame, said locating means including at least one connector hook and aperture on said panel frame and said cover panel.

27. A panel as set forth in claim 26, including:

a removable top cap having connector means for securing said cover panel to said panel frame along an upper portion thereof.

28. A panel as set forth in claim 27, including:

two of said cover panels placed in opposing relationship on either side of said panel frame.

* * * * *

UNITED STATES PATENT AND TRADEMARK OFFICE

CERTIFICATE OF CORRECTION

PATENT NO. : 5,175,969

DATED : January 5, 1993

INVENTOR(S) : Marvin C. Knauf et al.

It is certified that error appears in the above-identified patent and that said Letters Patent is hereby corrected as shown below:

Column 3, line 45;
After "installed" insert --on--.

Column 5, line 64;
After "square" insert --or rectangular--.

Column 5, line 68;
After "square" insert --or rectangular--.

Column 7, line 32;
After "square" insert --or rectangular--.

Column 7, line 53;
"a centered" should be --an--.

Column 9, line 13;
"180" should be --180°--.

Column 10, claim 6, line 52;
After "against" insert --said--.

UNITED STATES PATENT AND TRADEMARK OFFICE

CERTIFICATE OF CORRECTION

PATENT NO. : 5,175,969

DATED : January 5, 1993

INVENTOR(S) : Marvin C. Khauf et al.

It is certified that error appears in the above-indentified patent and that said Letters Patent is hereby corrected as shown below:

Column 12, claim 21, line 23;
"spaced" should be --space--.

Signed and Sealed this

Seventeenth Day of May, 1994

*Attest:*

Bruce Lehman

BRUCE LEHMAN

*Attesting Officer*

*Commissioner of Patents and Trademarks*